United States Patent [19]

Rehfeld

[11] 4,342,546

[45] Aug. 3, 1982

[54] AIR PUMP WITH CENTRIFUGAL FILTER

[75] Inventor: Frederick L. J. Rehfeld, Saginaw, Mich.

[73] Assignee: General Motors Corporation, Detroit, Mich.

[21] Appl. No.: 161,157

[22] Filed: Jun. 19, 1980

[51] Int. Cl.[3] ..... F01C 21/00; B01D 45/14

[52] U.S. Cl. ..... 418/47; 55/401; 55/406

[58] Field of Search ..... 418/46, 47, 137, 138, 418/241; 137/544, 565; 55/401, 406; 415/168

[56] References Cited

U.S. PATENT DOCUMENTS

| | | | |
|---|---|---|---|
| 3,356,292 | 12/1967 | Brewer et al. | 418/137 |
| 3,370,785 | 2/1968 | Pasek et al. | 418/47 |
| 3,419,208 | 12/1968 | Brewer et al. | 418/137 |
| 3,437,264 | 4/1969 | Rohde | 418/104 |
| 3,437,265 | 4/1969 | Rohde | 418/137 |
| 3,790,317 | 2/1974 | Hyde et al. | 418/137 |

*Primary Examiner*—John J. Vrablik
*Attorney, Agent, or Firm*—C. K. Veenstra

[57] ABSTRACT

In an air pump adapted to supply air to an engine exhaust system, an improved seal is provided between the pump housing and its centrifugal filter element.

2 Claims, 5 Drawing Figures

AIR PUMP WITH CENTRIFUGAL FILTER

TECHNICAL FIELD

This invention relates to an air pump having a centrifugal filter element and provides an improved seal between the pump housing and the filter element to inhibit passage of foreign material therebetween.

BACKGROUND

Automotive engines are frequently equipped with a pump which supplies air to the engine exhaust system to support oxidation of exhaust gas constituents. To assure adequate pump life, it is important that dust and water be filtered from the air flowing into the pump.

One pump used heretofore for that purpose is illustrated in U.S. Pat. No. 3,370,785 issued Feb. 27, 1968 in the name of F. L. J. Rehfeld and J. E. Pasek. That pump employed a rotating filter element which centrifuged foreign material out of the air flowing into the pump.

SUMMARY OF THE INVENTION

In that earlier unit, the centrifugal filter element had a lip which sealed against the inner surface of a rim on the pump housing. After years of experience with that earlier unit, it has now been discovered that the seal between the centrifugal filter element and the pump housing can be improved by positioning the lip to seal against the outer surface of the rim instead of the inner surface of the rim.

It is theorized that the air in the narrow gap between the filter element and the pump housing is turned by skin friction of the rotating filter element. The air will accordingly impart rotary motion to any foreign material entering the gap, causing the foreign material to be thrown centrifugally out of the gap. With the earlier construction, it is now thought that foreign material could be thrown against the stationary housing, migrate past the lip, and enter the pump. With the improved construction of this invention, foreign material would be thrown against the rotating filter element which will impart additional centrifugal force to expel the material away from the pump inlet.

The details as well as other features and advantages of this invention are set forth in the remainder of the specification and are shown in the accompanying drawings.

BEST MODE FOR CARRYING OUT THE INVENTION

Figure 1:
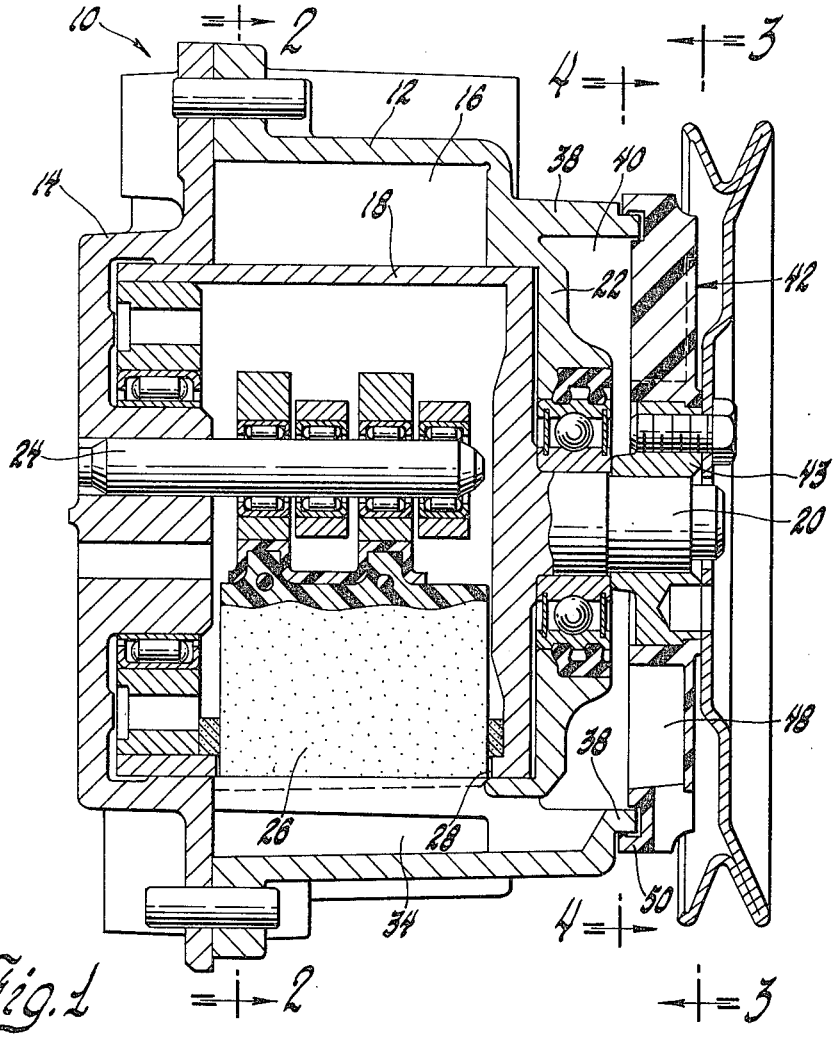
FIG. 1 is an axial sectional view of an air pump incorporating this invention.
Figure 2:
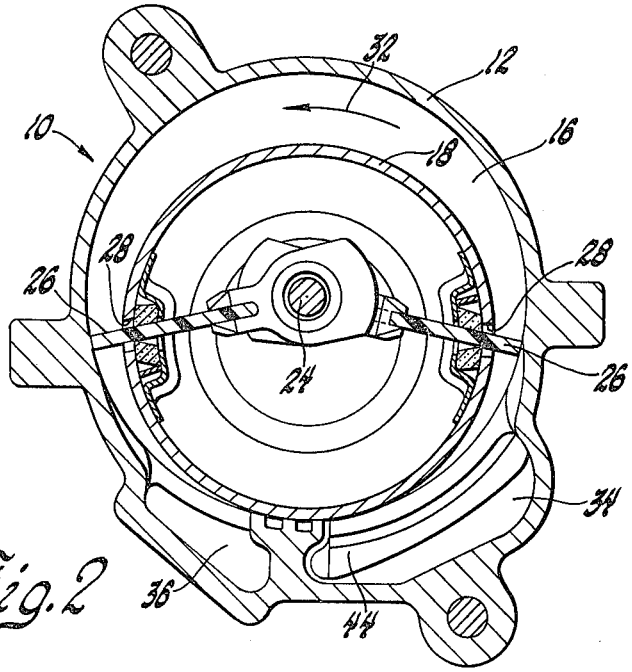
FIG. 2 is a transverse sectional view of this air pump, taken along line 2—2 of FIG. 1, showing additional details of its internal construction.

Referring first to FIGS. 1 and 2, the air pump 10 has a housing 12 closed by a cover plate 14 to define a pumping chamber 16. A pumping element or rotor 18 is disposed in pumping chamber 16 and has a drive shaft 20 extending through an end wall 22 of housing 12.

A shaft 24 is secured in cover plate 14 and supports a pair of vanes 26 which pass through a pair of slots 28 in rotor 18 to sweep around pumping chamber 16. When drive shaft 20 and rotor 18 are driven counterclockwise as illustrated by the arrow 32 in FIG. 2, vanes 26 draw air from an inlet chamber 34 formed in housing 12 and deliver it through pumping chamber 16 to an outlet chamber 36 also formed in housing 12.

The internal construction of pump 10 need not be set forth in detail because it is well known and forms no part of the present invention. Reference may be had to U.S. Pat. Nos. 3,356,292, 3,419,208, 3,437,264, 3,437,265 and 3,790,317 for additional understanding of that construction.

A rim 38 extends outwardly from end wall 22 concentric with shaft 20 and defines an annular recess 40 therebetween. A centrifugal filter element 42 is pressed onto a hub 43 of shaft 20; filter element 42 enclosed recess 40 to convert recess 40 to an inlet plenum 40 which connects with inlet chamber 34 through an opening 44 in end wall 22.

Figure 3:
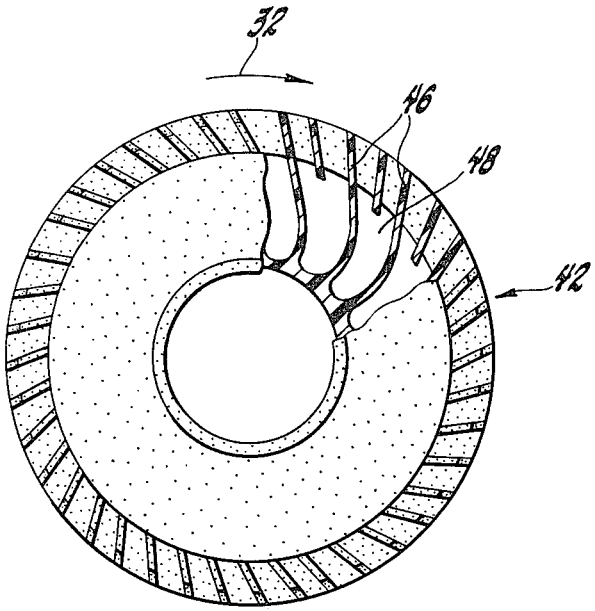
FIG. 3 is a front view of the centrifugal filter element, removed from the pump but indicated generally by line 3—3 of FIG. 1, having parts broken away to illustrate details of its construction.
Figure 4:
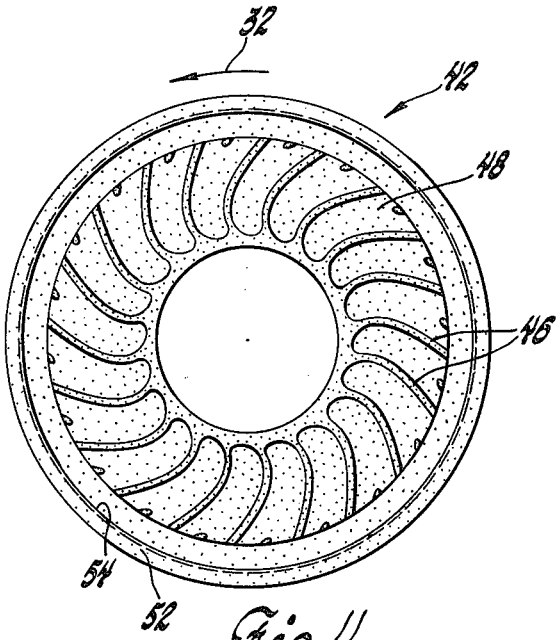
FIG. 4 is a rear view of the centrifugal filter element, removed from the pump but indicated generally by line 4—4 of FIG. 1, showing additional details of its construction.

As shown in FIGS. 3 and 4, centrifugal filter element 42 includes a plurality of curved vanes 46 extending substantially radially but angled slightly back from the direction of rotation indicated by the arrows 32. Vanes 46 define a plurality of curved passages 48 therebetween which extend from the atmosphere at their outer ends to inlet plenum 40 at their inner ends. When rotated in the direction shown, foreign material is separated and centrifuged out of the air flow which is drawn through passages 48 to inlet plenum 40.

Figure 5:
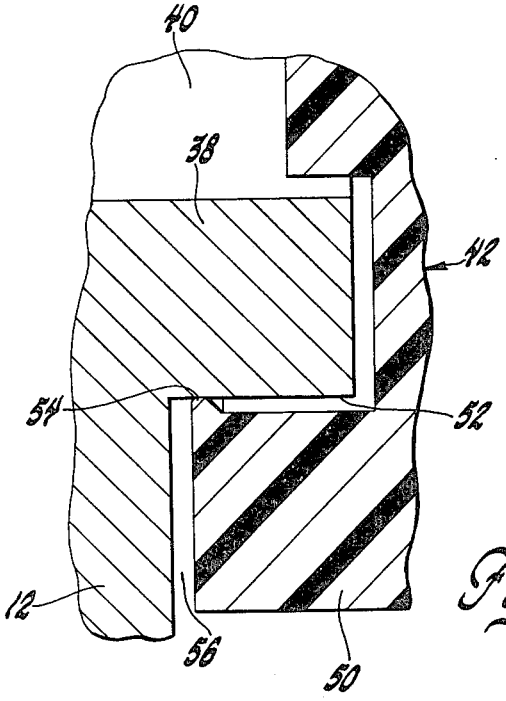
FIG. 5 is a view of a portion of the pump housing and filter element shown in FIG. 1 which has been enlarged to show the lip on the filter element which seals against the rim of the pump housing.

Referring now to FIGS. 1 and 5, it will be noted that centrifugal filter element 42 reaches beyond rim 38 and has a cylindrical extension 50 which overlies its outer surface 52. An annular lip 54 projects inwardly from extension 50 to seal against surface 52. After years of experience with the prior construction, it has been discovered that this construction more efficiently inhibits passage of foreign material between filter element 42 and housing 12. Although the reasons for the improvement are not fully understood, it is theorized that air in the narrow gap 56 between filter element 42 and housing 12 is turned by the skin friction of the rotating filter element 42 and imparts rotary motion to foreign material entering gap 56; the rotary motion would cause the foreign material to be thrown centrifugally out of gap 56 instead of reaching inlet plenum 40 and passing into pumping chamber 16. Moreover, in the prior construction the lip sealed against the inner surface of the rim, and it is thought that material thrown out of the gap could engage and migrate along the stationary inner surface into the inlet plenum; in the present construction, however, it is believed material thrown out of the gap would engage the rotating filter element 42 which would impart further centrifugal force to expel the foreign material away from the pump inlet.

The embodiments of the invention in which an exclusive property or privilege is claimed are defined as follows:

1. An air pump comprising a housing defining a pumping chamber having an end wall, a pumping member disposed in said chamber and having a shaft extending through said wall, said wall having an opening for air flow into said chamber, a rim extending outwardly from said wall concentric with said shaft and defining an annular recess between said rim and said shaft, and a centrifugal filter element mounted on said shaft and enclosing said recess to define an inlet plenum for air flow to said opening, said filter element having a plurality of curved passages extending substantially radially from the atmosphere at their outer ends to said plenum at their inner ends whereby foreign material is separated from and centrifuged out of the air flow through said passages to said plenum upon rotation of said shaft and said filter element, and wherein said filter element reaches beyond said rim and has a cylindrical extension which overlies and is closely adjacent the outer surface of said rim to inhibit passage of foreign material between said filter element and said rim.

2. An air pump comprising a housing defining a pumping chamber having an end wall, a pumping member disposed in said chamber and having a shaft extending through said wall, said wall having an opening for air flow into said chamber, a rim extending outwardly from said wall concentric with said shaft and defining an annular recess between said rim and said shaft, and a centrifugal filter element mounted on said shaft and enclosing said recess to define an inlet plenum for air flow to said opening, said filter element having a plurality of curved passages extending substantially radially from the atmosphere at their outer ends to said plenum at their inner ends whereby foreign material is separated from and centrifuged out of the air flow through said passages to said plenum upon rotation of said shaft and said filter element, and wherein said filter element reaches beyond said rim and has a cylindrical extension which overlies the outer surface of said rim to inhibit passage of foreign material between said filter element and said rim, said extension having an inwardly extending lip which seals against said outer surface to further inhibit passage of foreign material between said filter element and said rim.

* * * * *